United States Patent [19]

Akopiantz

[11] Patent Number: 4,946,050

[45] Date of Patent: Aug. 7, 1990

[54] DISPLAY RACK

[75] Inventor: Avedik Akopiantz, Greenwich, Conn.

[73] Assignee: Sweaters, U.S.A., Alamance, N.C.

[21] Appl. No.: 345,640

[22] Filed: Apr. 28, 1989

[51] Int. Cl.[5] ..... A47F 5/00

[52] U.S. Cl. ..... 211/182; 211/189; 211/204; D6/487; D6/488

[58] Field of Search ..... 211/182, 183, 189, 190, 211/204, 207, 208; D6/411, 415, 486, 487, 488

[56] References Cited

U.S. PATENT DOCUMENTS

D. 228,538 10/1973 Cohen ..... D6/415 X
D. 230,449 2/1974 Cohen ..... D6/194
D. 297,992 10/1988 Cohen ..... D6/411 X
D. 919,574 4/1909 Hayes .
3,533,513 10/1970 Berman ..... 211/182 X
3,984,002 10/1976 Howard ..... 211/45
4,645,081 2/1987 Korth ..... 211/208 X
4,787,319 11/1988 Dupraz ..... 211/182 X

*Primary Examiner*—Robert W. Gibson, Jr.
*Attorney, Agent, or Firm*—Rhodes, Coat & Bennett

[57] ABSTRACT

Adjacent pairs of upstanding support standards are joined or connected by one or more inverted curved segments to form a display rack. Some segments may be arranged at different elevations. The resulting display rack supports a prescribed number of garments in a reduced amount of floor space.

10 Claims, 2 Drawing Sheets

FIG. 1
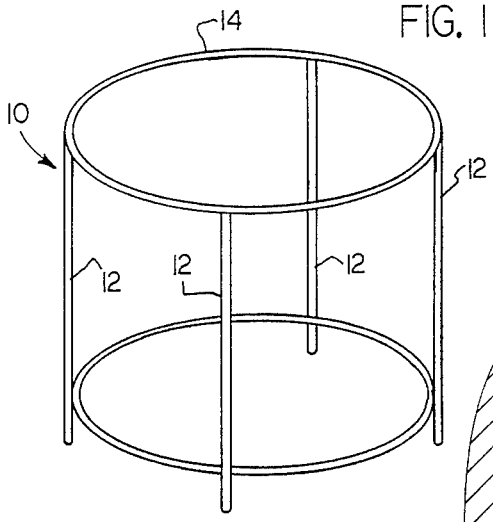
FIG. 3
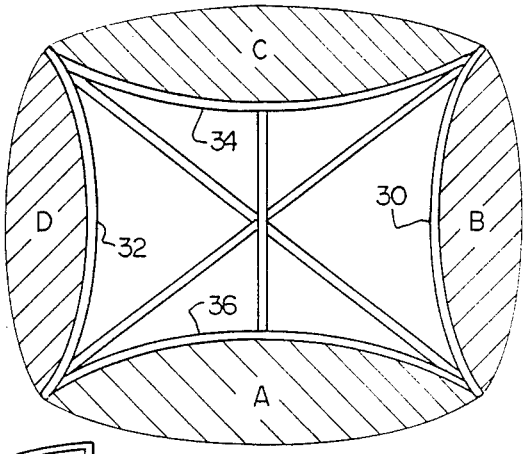
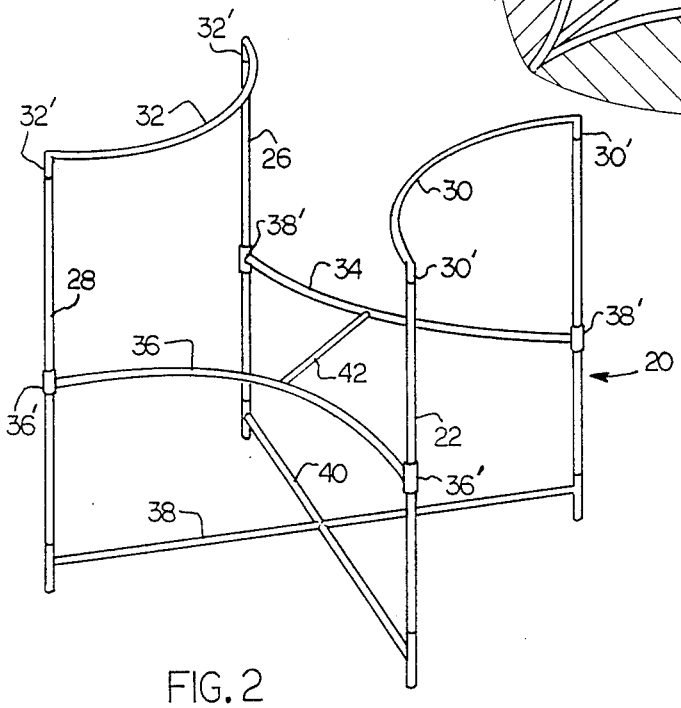
FIG. 2

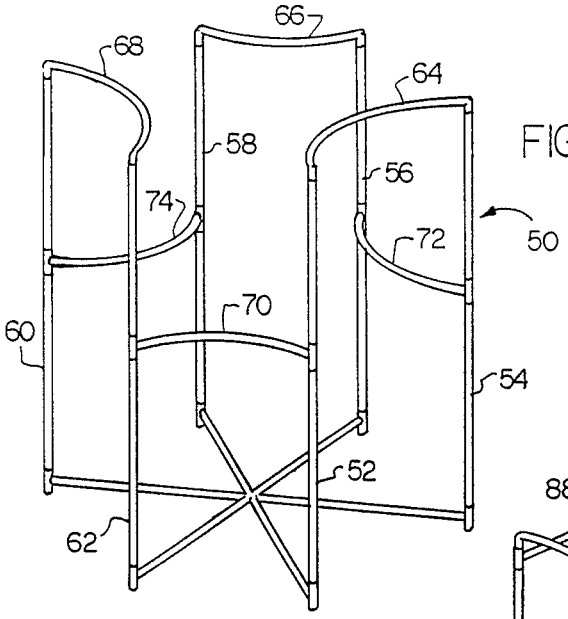
FIG. 4
FIG. 5
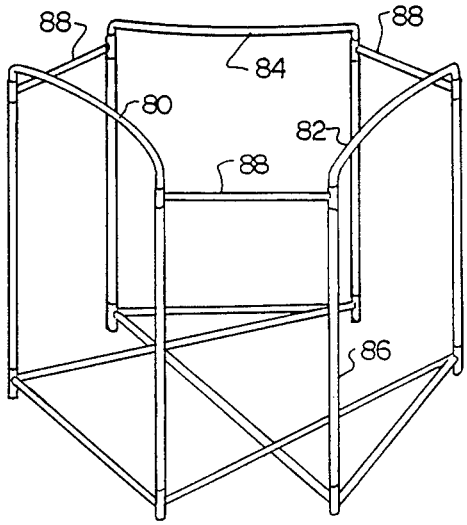
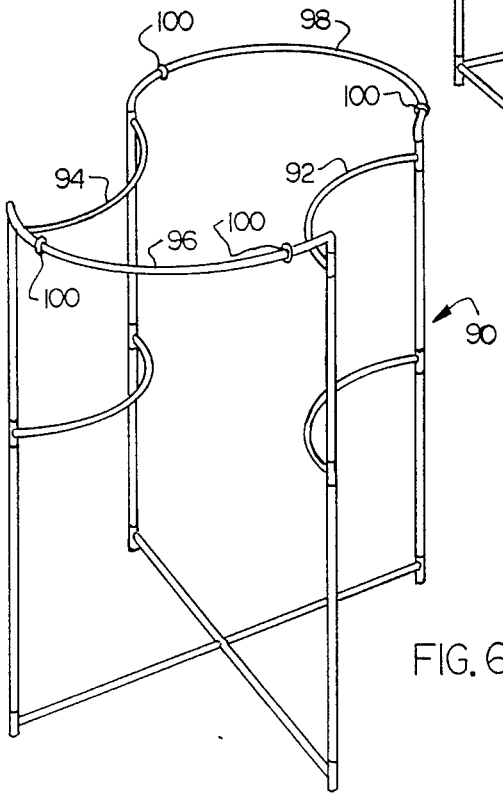
FIG. 6

DISPLAY RACK

BACKGROUND AND SUMMARY OF THE PRESENT INVENTION

This invention is directed to display racks, and more particularly to display racks of the type which are so constructed as to maximize the usable hanging space while consuming a minimum amount of floor space.

In the retail merchandising of goods, such as apparel, for example, it has always been an object to attractively display the goods. Ideally, the purpose of display racks is to neatly store merchandise, yet allow the potential customer sufficient access to examine selected articles. Therefore, display racks should neatly arrange and attractively display the merchandise, all the while maximizing the efficiency of floor space usage. Floor space is an extremely important consideration because of its relative cost in the merchandising operation.

One type of extremely old and functional display rack is called a "rounder". Such display racks are simply a plurality of vertical standards which support a circular rod from which merchandise is hung on hangers. This type of display rack is extremely popular for displaying slacks, sweaters, blouses, dresses, fabric, and other types of merchandise which can be hung or suspended in a vertical plane. In early days, most apparel and fabric was displayed on shelves containing vertical stacks of goods, each arranged in a horizontal plane. This display arrangement made inspection by customers difficult because, in order to inspect a piece of apparel or fabric near the bottom of the stack, it had to be removed. After inspection a clerk had to replace the item. On the other hand, "rounders" essentially formed a horizontal stack of articles arranged in vertical planes, and makes inspection much easier.

The drawbacks to "rounders" are that they consume an extremely large amount of floor space. This is true because such racks have a diameter of three feet or more. After articles are suspended from the racks, the total diameter of the loaded rack may be on the order of 7 or 8 feet. There is an open area in such display racks of approximately 4 feet in diameter which is essentially wasted. It is this wasted area that the apparatus of the present invention seeks to eliminate or reduce.

Two patents in the prior art have come to the attention of the applicant. They are U.S. Pat. Nos. 919,574 to Hayes issued Apr. 27, 1909 and DES 230,449 to Cohen issued Feb. 26, 1974. Both of these patents are illustrative of display racks which seek to maximize floor space. The Hayes patent illustrates a rounder containing a plurality of retractable, radially extending hanging elements or rods from which articles of merchandise are hung in a relatively tight configuration. The retractable feature allows the rods to be moved to an extended position for inspection of the merchandise. The number of articles that can be utilized on such a rounder is limited to the number of rods, and there is much wasted circumferential space between the radial hanging elements. The Cohen patent teaches an inclined spiral rod, however, also the individual hanging elements severely limit the number of articles which can be displayed on an inclined rod. Further, when articles are attempted to be suspended from an inclined rod, they react to the effect of gravity, and all tend to gravitate toward the bottom end of the rod. As a result, separating projections are necessarily spaced along the length of the rod, which limits the number of articles which can be suspended from any one rack.

In the present invention, the problem has been addressed by utilizing substantially horizontal, curved support segments attached to the support standards. In order to minimize the wasted space at the center of the rack, however, at least some of the support segments are inverted, i.e., curved inwardly toward the center of the rack, rather than curving outwardly, as in the case of a "rounder" in which all segments are in essence arcuate portions of the circumference of a circle.

Because of potential interference between adjacent segments at the same level, in preferred embodiments of the present invention, adjacent curved segments are vertically offset one from the other. Therefore, in some embodiments of the present invention, some curved segments are at one elevation, while other curved segments are at another elevation. This lends a rather unique and attractive appearance to the overall rack.

In the present invention, there is thus provided a display rack which includes a plurality of upstanding support standards arranged in such relation to each other as to form the vertices of a polygon. At least one inverted curved segment joins an adjacent pair of the support standards. In some embodiments, adjacent ones of the inverted curved segments are arranged at different elevations. Each curved segment is preferably arranged substantially horizontal so that hangers do not tend to slide in one direction or another. In a preferred embodiment, there are provided four segments with a first pair of opposed segments at a first higher elevation and a second pair of opposed segments at a lower elevation.

The term "inverted curved segment" as utilized in this application is intended to mean a curved or arcuate segment which curves inwardly from the ends thereof toward the vertical axis of the display rack. As such, one or more of the conventional outwardly curved or circumferential segments, which are space consuming, is eliminated.

It is, therefore, an object of the present invention to provide a rack for displaying hanging merchandise which minimizes the requisite floor space without reducing the number of articles of merchandise which can be suspended therefrom.

Other objects and a fuller understanding of the invention will become apparent from studying the following detailed description of a preferred embodiment along with the accompanying drawings in which:

FIG. 1 is a perspective view of a "rounder" constructed in accordance with conventional practice;

FIG. 2 is a perspective view of a display rack in accordance with the present invention;

FIG. 3 is schematic plan view illustrative of the space-saving attributes of the display rack of the present invention;

FIG. 4 is a perspective view similar to FIG. 2, except showing a second embodiment;

FIG. 5 is a perspective view illustrating a third embodiment; and

FIG. 6 is a perspective view illustrating a fourth embodiment.

DETAILED DESCRIPTION OF A PREFERRED EMBODIMENT

Turning now to the drawings, and particularly to FIG. 1, there is illustrated a "rounder" 10 of conventional design which includes a plurality of upstanding standards 12 and a circular support rod 14 which connects the upper ends of standards 12. Some type of suitable supporting or reinforcing framework 16 connects the lower end of the standards to form a supporting framework. Even though the "rounder" 10 can be provided with two vertically spaced support rods 14 (i.e., double tiered), good merchandising practice prohibits such tall, massive, unbroken structures in the middle of a merchandising area. When such a "rounder" is loaded, there is created a difficult situation for security personnel who are trying to oversee the events occurring throughout a large merchandising area. For this reason, double-decked "rounders" are undesirable.

In FIG. 2, there is illustrated the display rack 20 of the present invention which includes a plurality of upstanding support standards 22,24,26 and 28 arranged in such relation to each other as to form the vertices of a polygon (e.g., a rectangle in the embodiment of FIG. 2). A first inverted curved segment 30 joins the upper ends of standards 22,24. The corresponding opposite inverted curved segment 32 joins the upper ends of standards 26,28. A second pair of inverted curved segments are located approximately midway between the upper curved segments 30,32 and the floor. Segment 34 connects approximately the midpoints of standards 24,26 and curved segment 36 joins the midportions of standards 22,28 as illustrated in FIG. 2. Reinforcing struts 38,40 join opposite standards for reinforcing purposes. As can be seen in FIG. 2, alternate segments 30,32 are at the same level and alternate segments 34,36 are at the same level.

The segments 30,32,34,36 are illustrated as being arcuate or segments of an ellipse, however, may be any curved configuration, such as hyperbolic, or even an irregular curved surface. The opposite curved segments 34,36 may be joined by a reinforcing rod 42 if necessary. There may be an even number of segments (formed by an even number of standards) or an odd number of segments (formed by an odd number of standards). For example, in FIG. 4, there is illustrated a display rack having six upstanding support standards 52,54,56,58,60,62 which then provide support six inverted curved segments 64,66,68,70,72,74. It is important, however, that adjacent ones of the inverted curved segments are arranged at different elevations to avoid interference problems when articles are suspended therefrom.

FIG. 5 is illustrative of a second alternate embodiment in which the ends of the segments 80, 82, and 84 are supported by spaced upstanding standards 86, rather than a single upstanding standard. There is, therefore, provided a space (bridged by a short curved or straight rod 88) between the ends of adjacent curved segments 80,82,84 to alleviate somewhat the potential interference problem in a display rack in which the curved segments were all arranged on the same level. The space between the ends of adjacent curved segments should therefore be sufficient to allow hanging of articles on both segments without interference. This will obviously reduce the total hanging space available, however, some tradeoff between numbers of garments supported, floor space used, and aesthetics may be necessary.

As illustrated in FIG. 2, the display racks may be constructed in such a manner as to be easily assembled and disassembled to facilitate shipping and storage. For this purpose, the vertical standards 22,24,26,28 may be formed separately. Curved segments 30,32 are tubular in nature and include downwardly extending end portions 30',32' which are received on the upper ends of standards 22,24,26,28. Curved segments 34,36 include tubular end portions 34',36' which slide along the upstanding support standards 22,24,26,28 to the proper point where they are secured by set screws, cotter pins or some other similar connecting means. Alternately, the display rack can be erected and all members welded together, rather than being easily disassembled.

A somewhat different approach is illustrated in the rack 90 of FIG. 6, where inverted curved segments 92,94 are combined with arcuate segments 96,98. While the floor space savings is not as great, it is still significant. Stops 100 on segments 96,98 prevent interference between the garments thereon and the garments hung on segments 92,94. This type of rack may be used where it is desired to display various types of garments such as dresses, sweaters, and slacks or shirts.

Turning now to FIGS. 3, the savings in floor space is illustrated. Because of the inverted configuration of the support segments 30,32,34,36, the difference between the solid line illustration and the dotted line illustration (shaded areas A,B,C,D) is the savings in floor space. A polygon of four sides will have a space saving of greater that 36%, while a polygon of six sides will realize a floor space savings of approximately 17%.

While several preferred embodiments of the present invention have been illustrated and described hereinabove, it is apparent that various changes and modifications might be made without departing from the scope of the present invention which is set forth in the claims hereinbelow.

What is claimed is:

1. A display rack comprising:

(a) a plurality of upstanding support standards so arranged with respect to each other as to form the vertices of a polygon; and (b) at least one inwardly curved support rod joining at least one adjacent pair of support standards.

2. The display rack of claim 1 having a plurality of curved support rods, and in which adjacent ones of said curved support rods are arranged at different elevations.

3. The display rack according to claim 1 wherein said curved support rod extends substantially horizontally.

4. The display rack according to claim 2 in which there are an even number of adjacent ones of said curved support rod.

5. The display rack according to claim 4 wherein alternate adjacent ones of said support rod are at the same elevation.

6. The display rack according to claim 2 wherein adjacent ones of said curved support rod are elliptically shaped.

7. The display rack according to claim 2 wherein adjacent ones of said curved support rod are equal in length.

8. The display rack according to claim 2 wherein adjacent ones of said support rod are unequal in length.

9. The display rack according to claim 2 wherein there are provided four adjacent ones of said curved support rod, and the opposite ones of said support rod are the same elevation.

10. The display rack according to claim 1 having a plurality of curved support rods, and further including a space between adjacent ones of said support rods in which there is no curved support rod.

* * * * *